US007403702B2

(12) United States Patent
Thrush et al.

(10) Patent No.: US 7,403,702 B2
(45) Date of Patent: Jul. 22, 2008

(54) SECURE MOUNTING ARRANGEMENT FOR U-SHAPED BOLTS AND OTHER DEVICE

(75) Inventors: Richard Thrush, Jersey City, NJ (US); Walter G. Birdsell, Marlborough, MA (US)

(73) Assignee: Kaz, Incorporated, New York, NY (US)

( * ) Notice: Subject to any disclaimer, the term of this patent is extended or adjusted under 35 U.S.C. 154(b) by 165 days.

(21) Appl. No.: 11/403,399

(22) Filed: Apr. 12, 2006

(65) Prior Publication Data

US 2007/0242933 A1 Oct. 18, 2007

(51) Int. Cl.
*F24H 3/00* (2006.01)

(52) U.S. Cl. ..... 392/373; 392/347

(58) Field of Classification Search ..... None
See application file for complete search history.

(56) References Cited

U.S. PATENT DOCUMENTS 3,386,157 A * 6/1968 Jarvi ..... 29/458
3,771,884 A * 11/1973 Williams ..... 403/188
4,147,384 A * 4/1979 Heckethorn ..... 285/382.2
4,388,749 A * 6/1983 Sassak ..... 24/277
5,244,101 A * 9/1993 Palmer et al. ..... 211/5
6,948,703 B2 * 9/2005 Alberson et al. ..... 256/13.1
2003/0215305 A1 * 11/2003 Alberson et al. ..... 411/400
2006/0076777 A1 * 4/2006 Pirrone ..... 285/420
2007/0029460 A1 * 2/2007 Fitzler et al. ..... 248/560

* cited by examiner

*Primary Examiner*—Thor S. Campbell
(74) *Attorney, Agent, or Firm*—Darby & Darby

(57) ABSTRACT

A U-shaped bolt including a closed end and two legs at an open end is self-retaining on a first object. The U-shaped bolt includes projections forming an opening to the closed end adapted to be smaller than the width of the first object. The projections retain the U-shaped bolts on the first object. The U-shaped bolt is used in conjunction with a space heater having a plurality of heating elements connected by channels. The U-shaped bolt is retained on the channels to warrant proper assembly of the space heater.

11 Claims, 2 Drawing Sheets

SECURE MOUNTING ARRANGEMENT FOR U-SHAPED BOLTS AND OTHER DEVICE

FIELD OF THE INVENTION

The invention generally relates to secure mounting devices and more specifically relates to U-shaped attachment devices which include a closed end that securely fits on an object.

BACKGROUND

U-shaped bolts are used in many different industries for attaching two objects. Typically, a first object is received within the closed end of the U-shaped bolt and the legs at the free end of the bolt are inserted through holes or notches in a second object. The bolt is then secured using nuts, clamps or the like to prevent the second object from being removed from the legs of the bolt. Often, the second object is a mounting plate which has other objects attached thereto, such that the other objects may be indirectly attached to the first object by means of the mounting plate and U-shaped bolt.

U-shaped bolts are especially useful for attaching two objects when a very secure attachment is required and it is undesirable or impossible to place bores in the first object for conventionally bolting or screwing the objects together. For instance, U-shaped bolts are useful when the first object contains a liquid or gas. Accordingly, U-shaped bolts are a preferred means for attaching pipes to structures or, conversely, attaching objects to pipes.

One drawback of conventional u-bolts is that there is no practical or convenient way to pre-set the u-bolt onto the first object. Unlike using a conventional bolt, which usually requires holes in both the first and second object, using a u-bolt does not require that the first object have any holes or other constraining geometry. Consequently, the user must hold the u-bolt in place while placing the second object on the legs. Further, the user must hold the u-bolt, first object and second object all in place, while attaching the nuts or the like to the legs.

The fact that conventional u-bolts cannot be pre-set on the first object also leads to inconveniences in consumer goods where post-sale assembly is required. Products which require partial assembly on the part of the consumer should ideally be "error-proof" so that the parts include holes or other indicators showing where the conventional attachment members (i.e. bolts, nuts, screws, etc.) should be placed. A well designed product using conventional attachment members will only have one possible configuration that uses all of the attachment members. Thus, the consumer is constrained to use the attachment members appropriately. However, if the unassembled product includes a u-bolt there will be no hole or other indicator on the first object showing where to place the u-bolt. Consequently, the user may inadvertently place the u-bolt in an incorrect position on the first object.

As an example, the space-heater 100 shown in FIG. 1 has been correctly assembled. Space-heater 100 includes an end unit 110 including controls and the like and a plurality of elongated heat radiating elements 120 each with a top end 122 and a bottom end 124. Space-heater 100 also includes channels 132 between each of the heating elements 120 at both the top end 122 and the bottom end 124. When properly assembled, wheels 160 are attached to the bottom of the space-heater 100. Conventional u-bolts 200 each receive two of the channels 130 at the bottom end 124 of space heater 100. Support plates 150 each with a set of wheels 160 attached thereto are secured to the conventional u-bolts 200. The wheels 160 are attached to the outermost channels 130 to provide a stable base for the space-heater 100. The design of the space-heater 100 and conventional u-bolts 200 provide several plausible opportunities for the user to improperly assemble the space-heater. For example, one of the sets of wheels 160 may be placed on the inner channel 132. Alternatively, the sets of wheels 160 may be attached to the upper end 122 of the space-heater 100 such that the space-heater 100 is used upside down.

SUMMARY OF THE INVENTION

The present invention is directed to a U-shaped bolt having a novel design which allows the U-shaped bolt to be pre-set on a first object which it receives. The novel U-shaped bolts allow first and second objects to be assembled more easily and allows manufacturers to pre-set the U-shaped bolts on products which are sold unassembled.

The U-shaped bolt of the present invention is an elongate structure which includes a closed end and an open end. The open end is defined by two legs. In use, a first object is received by the closed end and a second object is placed over the legs such that the legs pass through openings in the second object. Securing means are then placed on the legs such that the second object may not be easily or accidentally removed from the U-shaped bolt.

The closed end of the U-shaped bolt may have a contour that conforms to the profile of the first object. Accordingly, the closed end may be circular, triangular, square, oval, or may be adapted to fit on any closed shape.

The U-shaped bolt includes a projection between the apex of the closed end and the ends of the legs. The projection creates an opening to the closed end which is smaller than the widest inner dimension of the closed end of the U-shaped bolt. Thus, an appropriate first object may have a width which is larger than the opening such that the U-shaped bolt may be pre-set on the first object and not easily removed therefrom.

The U-shaped bolt may be formed of any suitable material such as metals, plastics and composites, but should have some elasticity.

To pre-set the U-shaped bolt, the legs are spread apart such that the open end is spread and the size of the opening is increased. The U-shaped bolt is then placed on the first object with the enlarged opening passing the widest part of the first object. The legs are then released and the opening returns to its original position. Consequently, the U-shaped bolt cannot easily be removed from the first object.

A second object is then placed on the U-shaped bolt with the legs passing through openings in the second object. The second object is then held on the U-shaped bolt by retaining means such as clamps, nuts or an integrated retaining structure within the U-shaped bolt itself.

One device which may take advantage of the U-shaped bolt is a space heater. The space-heater includes an end unit including controls and the like and a plurality of elongated heat radiating elements. The heat radiating elements each have a top end and a bottom end. Channels are provided between both the top ends and bottom ends of each heat radiating element. Support plates with wheels attached thereto are fixed to the space-heater using the U-shaped bolts. The closed ends of the U-shaped bolts receive the channels connecting the bottom ends of the heat radiating elements.

Use of the U-shaped bolts with the space heater allows the unit to be sold unassembled but with the U-shaped bolts pre-set on the correct channels of the space heater. In a relaxed state the opening to the closed end of the U-shaped bolt is smaller than the diameter of the channel. Accordingly, the U-shaped bolt cannot be accidentally removed from the space heater. Thus, when the user attaches the support plate and wheels to the space heater there is no chance that the unit will be assembled incorrectly.

BRIEF DESCRIPTION OF THE DRAWINGS

These and other objects and features of the invention will become more apparent by referring to the drawings, in which.

DETAILED DESCRIPTION OF THE PREFERRED EMBODIMENTS

Figure 1:
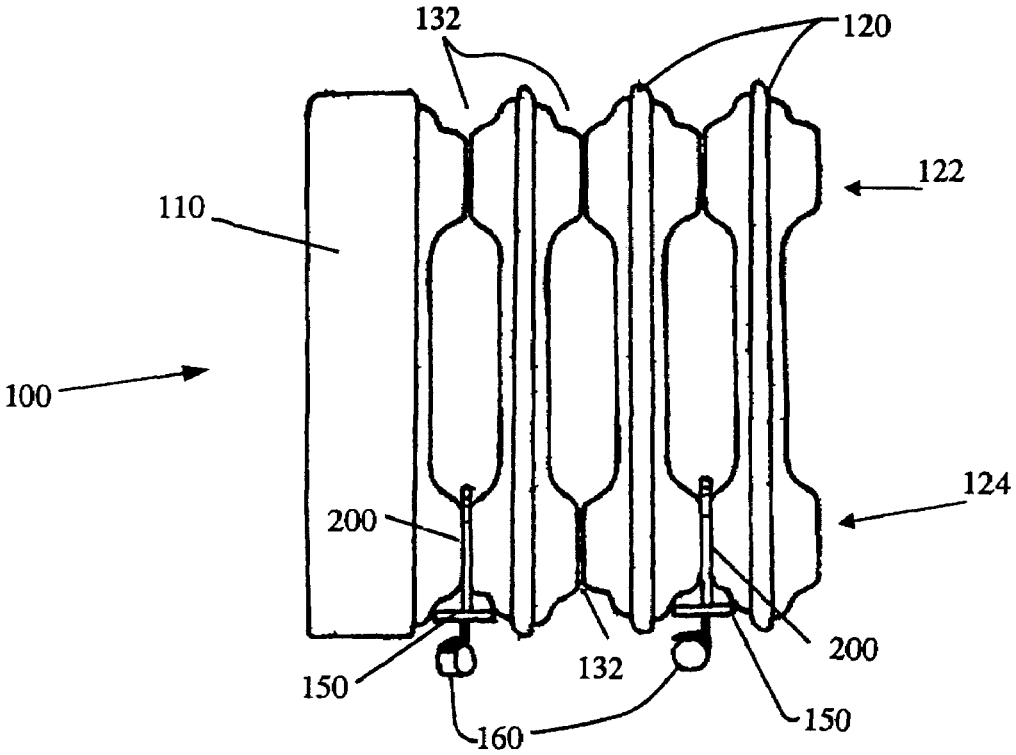
FIG. 1 is an illustration of a space-heater with wheels attached using conventional u-bolts.
Figure 2:
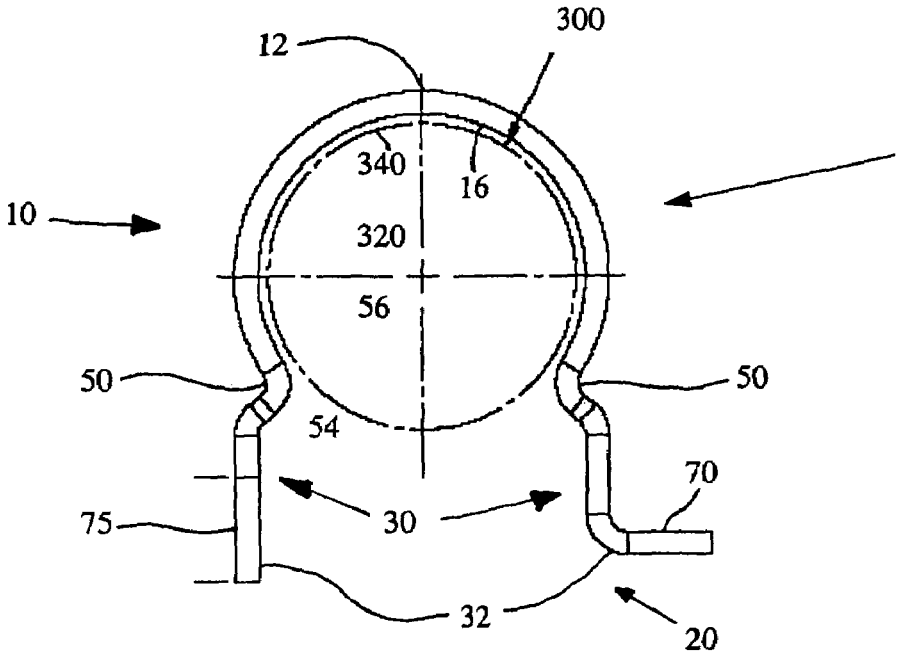
FIG. 2 is an illustration of a U-shaped bolt in accordance with the present invention.

The U-shaped bolt 1 of the present invention, as shown in FIG. 2, is an elongate structure which includes a closed end 10 and an open end 20. The open end 20 is defined by at least two legs 30. In operation, a first object is received by the closed end 10 and a second object is placed over the legs 30 such that the legs 30 pass through openings in the second object. Securing means are then placed on the legs 30 such that the second object may not be easily or accidentally removed from the U-shaped bolt 1.

The closed end 10 of the U-shaped bolt 1 may have a contour 16 that forms to the profile of the first object. Accordingly, the closed end 10 may be triangular, square, oval, or may be adapted to fit on any closed shape. Most commonly, the first object will be circular, so as to engage a pipe. Therefore, the invention will herein be described with respect to an embodiment adapted for use with a circular first object.

U-shaped bolt 1 includes a projection 50 between the apex 12 of the closed end 10 and ends 32 of the legs 30. The projection 50 may be on one or both sides and may be a bent section of U-shaped bolt 1 as shown in FIG. 2 or may be a flange or the like attached to the U-shaped bolt 1. The bent portion may bend in toward the center of the U-shaped bolt. Another bend may also be included at the top of the leg 30 such that the legs 30 are parallel. The projection 50 creates an opening 54 which is smaller than the inner dimension 56 of the closed end 10 of the U-shaped bolt 1. Thus, an appropriate first object 300 may have a cross-sectional width 320 which is larger than opening 54, such that the U-shaped bolt 1 may be pre-set on the first object 300 and not easily removed therefrom.

The U-shaped bolt 1 may be formed of any suitable material such as metals, plastics and composites, but should have some elasticity. Preferred embodiments include steel, aluminum and hard plastic.

To pre-set U-shaped bolt 1, legs 30 are spread apart such that the open end 20 is spread and the size of opening 54 is increased. The U-shaped bolt 1 is then placed on the first object 300 with the enlarged opening 54 passing over the width 320 of the first object 300. The legs 30 are then released and the opening 54 returns to its original position. Consequently, the U-shaped bolt 1 cannot be easily removed from the first object 300 without again spreading the legs 30.

In its relaxed state, the contour 16 of the closed end 10 may be the same size or slightly larger than the profile 340 of the first object 300. Alternatively, the contour 16 may be slightly smaller than the profile 340 of the first object 300. As a result, the tension in the U-shaped bolt 1 will hold it firmly in place on the first object 300.

A second object is then placed on U-shaped bolt 1 with legs 30 passing through openings in the second object. The second object is then held on the U-shaped bolt by a retaining structure. The U-shaped bolt 1 may include any of a large variety of retaining structures. For example, clamps may be placed on the legs 30 opposite the closed end to prevent the second object from coming off. Alternatively, the legs 30 may include a bent foot 70 as shown in FIG. 2 such that the foot holds the second object on the U-shaped bolt. In another embodiment the legs 30 may include threading 75 as shown in FIG. 2 such that nuts or the like may hold the second object on the U-shaped bolt 1.

Figure 3:
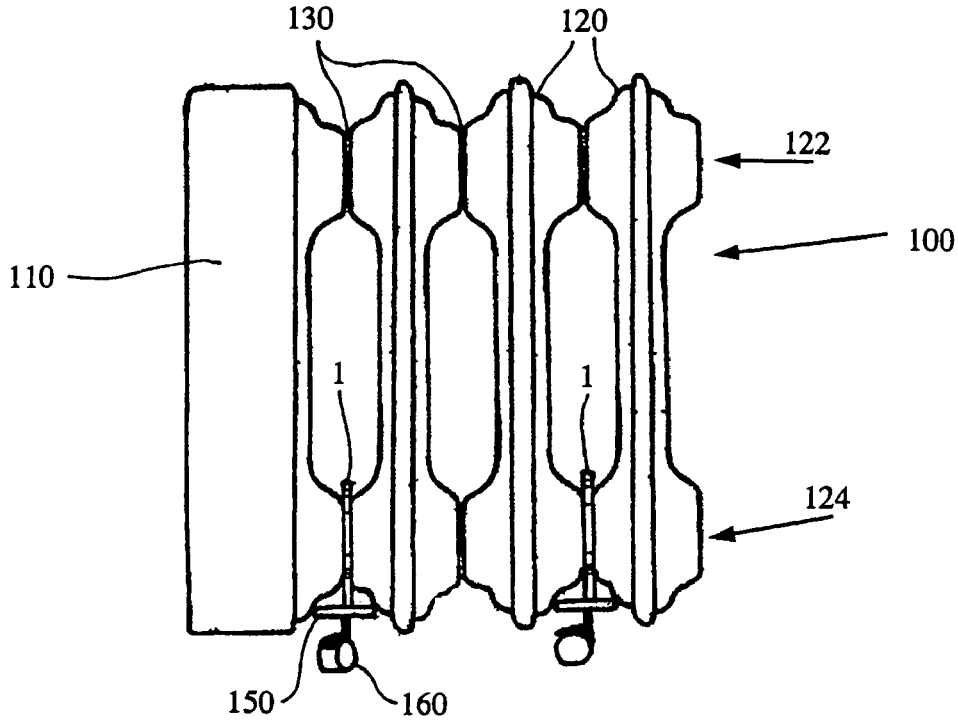
FIG. 3 is an illustration of an unassembled space-heater with pre-set U-shaped bolts of the present invention.

One device which may take advantage of the U-shaped bolt 1 is the space heater 100 shown in FIG. 3. As illustrated, the space-heater 100 includes an end unit 110 including controls and the like and a plurality of elongated heat radiating elements 120. The heating elements each have a top end 122 and a bottom end 124. Channels 130 are provided between both the top ends 122 and bottom ends 124 of each heat radiating element 120. Support plates 150 with wheels 160 attached thereto are fixed to the space-heater 100 using U-shaped bolts 1. The closed ends 10 of the U-shaped bolts 1 receives the channels 130 connecting the bottom ends 124 of heat radiating elements 120. In one embodiment, the closed ends 10 are attached to the channels 130 toward the outside of the space heater 100. This provides adequate stability for the space heater 100.

Figure 4:
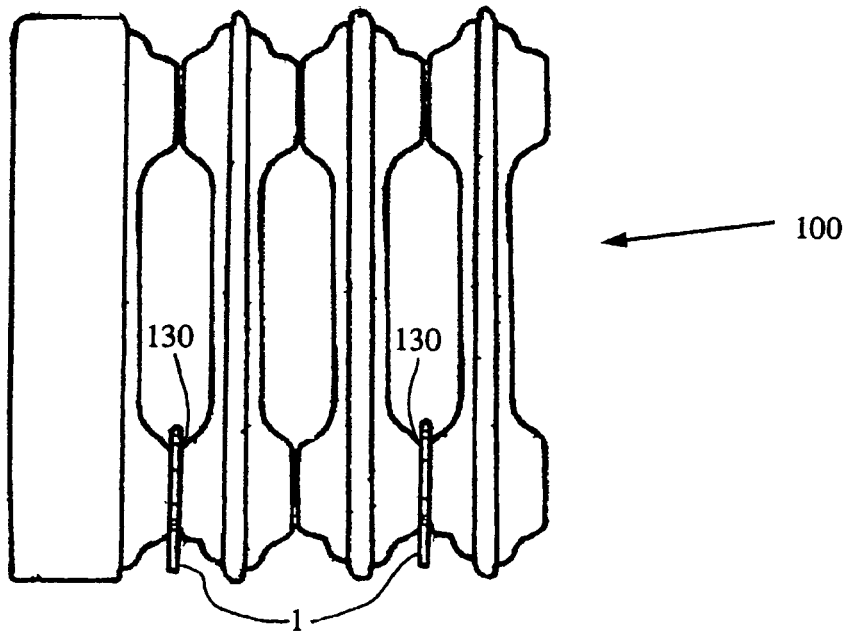
FIG. 4 is an illustration of an assembled space-heater including U-shaped bolts in accordance with the present invention.

Use of the U-shaped bolts 1 with the space heater 100 allows the unit to be sold as shown in FIG. 4. The space heater 100 is unassembled but the U-shaped bolts 1 are pre-set on the correct channels 130 of the space heater 100. In a relaxed state the opening 54 to the closed end 10 of the U-shaped bolt 1 is smaller than the diameter of the channel 130. Accordingly, the U-shaped bolt 1 cannot be accidentally removed from the space heater 100. Thus, when the user attaches the support plate 150 and wheels 160 to the space heater 100 there is no chance that the unit will be assembled incorrectly.

Although the preferred form of the invention has been shown and described, many features may be varied, as will readily be apparent to those skilled in this art. The U-shaped bolt may be used to attach any number of objects. Similarly, the projection of the U-shaped bolt is not limited to a bent portion or a flange, but could also be a collar of other obstruction device. It is the intention, therefore, to be limited only as indicated by the scope of the claims appended hereto.

We claim:

1. A space heater comprising:

a plurality of elongated heat radiating elements;

a plurality of channels connecting the elongate heat radiating elements; and at least one U-shaped bolt receiving one of the channels, each U-shaped bolt comprising:

a closed end receiving the channel, the closed end having an inner dimension substantially equal to a dimension of the channel;

an open end with two legs; and at least one projection disposed between the closed end and a tip of one leg, the projection defining an opening having a dimension which is smaller than the dimension of the channel and retains the U-shaped bolt on the channel.

2. The space heater of claim 1 wherein the U-shaped bolt includes projections between the closed end and a tip of each leg.

3. The space heater of claim 1 wherein the bolt is formed of an elastic material.

4. The space heater of claim 1 wherein the elastic material is a steel.

5. The space heater of claim 1 wherein a portion of the two legs are parallel.

6. The space heater of claim 1 wherein the end of at least one leg is threaded.

7. The space heater of claim 1 wherein the end of at least one leg includes a foot adapted to secure an object on the bolt.

8. The space heater of claim 1 wherein the end of one leg is threaded and the end of the other leg includes a foot adapted to secure an object on the bolt.

9. The space heater of claim 1, further including wheels mounted to a plate, wherein the U-shaped bolt secures the plate to the heat radiating elements.

10. The space heater of claim 9 wherein the legs of the U-shaped bolt pass through holes in the plate.

11. A space heater comprising:

a plurality of elongated heat radiating elements;

a plurality of channels connecting the elongate heat radiating elements;

at least one plate including wheels attached thereto; and at least one U-shaped bolt, each U-shaped bolt comprising:

a closed end receiving one of the plurality of channels, the closed end having an inner dimension substantially equal to a dimension of the channel;

an open end with two legs, the legs passing through at least one hole in the plate, the first leg being threaded and including a nut thereon and the second leg including a foot, the nut and foot retaining the plate on the U-shaped bolt; and at least one projection disposed between the closed end and a tip of one leg, the projection defining an opening having a dimension which is smaller than the dimension of the channel and retains the U-shaped bolt on the channel.

* * * * *